United States Patent [19]

Dickakian

[11] Patent Number: 4,715,945

[45] Date of Patent: Dec. 29, 1987

[54] AROMATIC PITCH

[75] Inventor: Ghazi Dickakian, Scotch Plains, N.J.

[73] Assignee: E. I. Du Pont de Nemours and Company, Wilmington, Del.

[21] Appl. No.: 492,593

[22] Filed: May 9, 1983

Related U.S. Application Data

[63] Continuation of Ser. No. 241,431, Mar. 6, 1981, abandoned.

[51] Int. Cl.[4] ..... C01C 1/16

[52] U.S. Cl. ..... 208/40; 208/44; 208/22; 208/131

[58] Field of Search ..... 208/40, 22, 44

[56] References Cited

U.S. PATENT DOCUMENTS

| | | | |
|---|---|---|---|
| 2,992,181 | 7/1961 | Renner | 208/40 |
| 3,373,101 | 3/1963 | Folkins et al. | 208/40 |
| 3,725,240 | 5/1971 | Baum | 208/40 X |
| 3,835,024 | 9/1974 | Veda et al. | 208/22 |
| 3,928,169 | 12/1975 | Conroy | 208/22 |
| 3,928,170 | 12/1975 | Takahashi et al. | 208/40 |
| 4,086,156 | 4/1978 | Dickakian | 208/44 X |
| 4,219,404 | 8/1980 | Dickakian | 208/22 X |
| 4,271,006 | 6/1981 | Dickakian | 208/40 |

*Primary Examiner*—Andrew H. Metz
*Assistant Examiner*—Glenn Caldarola

[57] ABSTRACT

A new and novel process is described for preparing an aromatic pitch having a high liquid crystal fraction and being suitable for carbon artifact manufacture, such as for the manufacture of pitch carbon fiber.

5 Claims, No Drawings

AROMATIC PITCH

This application is a continuation of application Ser. No. 241,431, filed Mar. 6, 1981, now abandoned.

Aromatic pitches such as coal tar pitch or petroleum pitch are made of a complex mixture of alkyl-substituted polycondensed aromatics having a high degree of aromatic ring condensation (as evidenced by the carbon/-hydrogen atomic ratio). One simple method to characterize these pitches is by the use of solvent analysis, for example, the degree of insolubility in benzene, toluene, pyridine, quinoline, or anthracene. For the purposes of the present invention, aromatic pitches are characterized by their insolubilities in toluene and quinoline.

The solubility analysis for determining quinoline insolubles is conducted according to ASTM D2318-66 protocol; the solubility analysis for determining toluene insolubilities is conducted by mixing 40 grams of a sample in 320 ml of toluene over an 18-hour time period, filtering, washing the insolubles in additional toluene, drying, and calculating the yield of insolubles as a percentage of initial sample.

The production of a highly aromatic pitch which will yield a non-ordered, isotropic carbon has previously been described in my U.S. Pat. No. 3,721,658. More particularly, this patent describes a process for preparing an aromatic pitch by the catalytic air oxidation of an aromatic feedstock such as steam-cracked tar, at a temperature of 240°-260° C. This pitch has low toluene insolubles (about 15%) and very low quinoline insolubles. Because of the chemical structure of the pitch, and not because of the toluene or quinoline insolubles content, this pitch on melting or carbonizing will yield a highly isotropic carbon.

Another example of aromatic pitch production may be found in U.S. Pat. No. 4,086,156. This patent describes a method for preparing an aromatic pitch by the thermal treatment of steam cracker tar in the absence of oxygen and at a temperature of 380°-390° C. The pitch obtained by this method contains a low concentration of toluene and quinoline insolubles and will produce an isotropic carbon on melting or carbonizing.

In addition, my co-pending patent application (U.S. Ser. No. 143,136) discloses the production of an aromatic, low Ti pitch. However, this pitch requires a two-stage extraction process in order to prepare carbon precursor.

Accordingly, the process of the present invention describes a method to prepare a highly polycondensed aromatic hydrocarbon pitch with a defined composition by the catalytic or non-catalytic thermal treatment of a low molecular weight feed comprised of alkyl-substituted polycondensed hydrocarbon aromatic fraction obtained from catalytic cracking residue (cat cracker bottoms or CCB) having a specific chemical and molecular structure.

The important feature of the pitch produced by the method according to the present invention is that it produces carbon on melting or carbonization with anisotropic structure, that is, an ordered or crystalline structure, as determined by measuring the optical activity of the carbon via polarized light microscopy. This type of pitch is useful for the production of carbon products with anisotropic structure such as pitch carbon fiber or needle coke.

More particularly, the process of the present invention specifically describes a method to prepare a low softening point (200°-300° C.) aromatic pitch with a definite composition. The pitch made in accordance with the present invention contains a high toluene insoluble content (50-90 weight percent) and a high quinoline insoluble content (10-60 weight percent). The high content of toluene and quinoline insolubles is desired in this pitch (HTHQ pitch) as this fraction is essential for development of anisotropic structure when melting or carbonizing the pitch in an inert atmosphere.

Not all aromatic compounds containing polycondensed aromatic rings are suitable for the production of HTHQ pitch with the desired composition and characteristics. For example, coal tars from the high temperature carbonization of coal, steam cracker tar from the steam cracking of gas oil or naphtha, or coal tar from coal gasification or liquification are highly aromatic and composed of polycondensed aromatics but are not suitable for the production of HTHQ pitch because they do not have the desired chemical and molecular structure needed. Accordingly, the production of an aromatic pitch which will yield a highly ordered anisotropic structured carbon requires a specific polycondensed aromatic feed with a definite chemical and molecular structure.

U.S. Pat. No. 4,005,183, for example, describes the production of pitch with high quinoline insolubles by the atmospheric heat soaking of a high softening point (110°-115° C.) petroleum pitch. The process described in U.S. Pat. No. 4,005,183 requires a feed which is physically, chemically, and thermally different from CCB or fractions which are mainly low molecular weight polycondensed aromatics. The present invention's three-stage process is also different from the process described in U.S. Pat. No. 4,005,183, which is done by heating a petroleum pitch at 400° C. for 32 hours at atmospheric pressure until the high quinoline insolubles content is formed in the pitch. Table I illustrates the chemical and physical differences between petroleum pitch and cat cracker bottom feedstock.

TABLE I

| | Petroleum Pitch | CCB Distillate | Vacuum Stripped CCB |
|---|---|---|---|
| Toluene Insolubles (%) | 10 | 0 | 0 |
| Softening Point, °C. | 122 | Liquid | 20-40 |
| Aromatic Carbon (atom %) | 84 | 55-65 | 55-65 |
| Coking Value at 550° C. (wt. %) | 56 | 0 | 14 |
| Asphaltene Content, wt. % (n-heptane insolubles) | 70 | 0 | 4 |
| Carbon/Hydrogen Atomic Ratio | 1.5 | 0.95 | 1.0 |

A suitable aromatic feed for the production of HTHQ pitch, as noted above, is the aromatic residue obtained from the cracking of refinery distillates. This residual feedstock is called cat cracker bottoms (CCB), refers to that fraction of the product of the cat cracking process which boils in the range of from about 200° to about 500° C., and is presently a by-product residue. Its chemical structure can be defined by quantitatively measuring its carbon and proton nuclear magnetic resonance spectroscopy (CMR and NMR); a typical distribution is given in Table II.

TABLE II

| Carbon and Proton Distribution of CCB | |
|---|---|
| Aromatic carbon (atom %) | 55-65 |

TABLE II-continued

| Carbon and Proton Distribution of CCB | |
|---|---|
| Aromatic protons (%) | 24–35 |
| Benzylic protons (%) | 27–31 |
| Paraffinic protons (%) | 47–33 |

More particularly, the specifications for a typical cat cracker bottom that is a suitable feedstock for the present invention are given in Table III.

TABLE III

| Characteristics of Cat Cracker Bottoms | |
|---|---|
| Physical Characteristics | |
| Viscosity cst at 210° C. | 1.0–10.0 |
| Ash Content, wt % | 0.010–2.0 |
| Coking Value (wt % at 550° C.) | 6.0–18.0 |
| Asphaltene (n-heptane insolubles), % | 0.1–12.0 |
| Toluene Insolubles (0.35μ), % | 0.010–1.0 |
| Number Average Mol. wt. | 220–290 |
| Elemental Analysis | |
| Carbon, % | 88.0–90.32 |
| Hydrogen, % | 7.74–7.40 |
| Oxygen, % | 0.10–0.30 |
| Sulfur, % | 1.0–4.5 |
| Carbon/Hydrogen Atomic Ratio | 0.90–1.0 |
| Chemical Analysis by Proton NMR | |
| Aromatic Carbon (atom %) | 55–65 |
| Aromatic Ring Distribution (by Mass Spectroscopy) | |
| 1 Ring (%) | 1.2 |
| 2 Rings (%) | 23.6 |
| 3 Rings (%) | 37.5 |
| 4 Rings (%) | 31.8 |
| 5 Rings (%) | 3.8 |
| 6 Rings (%) | 0.9 |
| Molecular Weight Distribution (by Mass Spectroscopy) | |
| 175–200 (%) | 2.9 |
| 200–225 (%) | 13.4 |
| 225–250 (%) | 29.5 |
| 250–275 (%) | 23.1 |
| 275–300 (%) | 15.5 |
| 300–325 (%) | 6.8 |
| 325–350 (%) | 3.5 |
| Composition by Clay-Silica Gel Chromatography | |
| Aromatic, % | 62.2 |
| Saturate, % | 17.0 |
| Polar, % | 18.3 |

Although the total cat cracker bottoms fraction can be used as feedstock for the manufacture of the aromatic pitch according to any invention, this would require the thermal treatment of the feedstock to be carried out under pressure; this is capital intensive as it requires equipment capable of operating under pressure.

One method to perform the required thermal treatment under atmospheric pressure is by removing the low boiling point fraction, that is, the fraction which boils below the desired thermal treatment temperature. This can be carried out using various methods, such as (1) by the vacuum stripping of cat cracker bottoms at elevated temperatures and reduced (1–100 mm Hg) pressures or (2) by the fractional distillation of cat cracker bottoms at elevated temperatures, for example, between 200° and 300° C., and reduced pressures, for example, between 200–500 microns of mercury. Fractional distillation results in either a single or several distillate fractions and a residue referred to as CCB residue which is that fraction not distillable at temperatures of up to 530° C. and at a pressure of about 350 to 450 microns of mercury. The distillate fraction has a boiling point in the range of from about 500° F. to about 1000° F.

The CCB distillate and CCB residue obtained by fractionation are highly aromatic, being composed of polycondensed aromatics, but vary in their molecular weight, aromatic ring distribution, and coking characteristics. The following Table 4 graphically summarizes some of these differences.

TABLE IV

| Characteristics of CCB Distillate and Residue | CCB Distillate | CCB Residue |
|---|---|---|
| Aromatic Carbons (atom % by NMR) | 62 | 68 |
| Molecular Weight | 270 | 329 |
| Aromatic Ring Distribution | | |
| 2 rings (%) | 12 | 0 |
| 3 rings (%) | 29 | 0 |
| 4 rings (%) | 46 | 0 |
| 5 rings (%) | 8 | 0 |
| 6 rings+ (%) | 1 | 10 |

The CCB distillate is composed of aromatics having 3, 4, and 5 aromatic rings polycondensed with hydrogen and carbon as the main component, and also containing (but to a lesser extent) polycondensed aromatics with polar atoms such as sulfur or oxygen. Typical of the polycondensed aromatic compounds found in CCB feed or distillate are napthenonaphthalene, acenaphthenes, phenanthrene, naphthenophenanthrene, pyrenes, chrysenes, cholantrenes, benzopyrenes, indothiopenes, naphthothiopenes, naphthano-naphthothiopenes, acenophthylene-thiopenes, and anthracenothiophenes.

I have discovered that there are many process variations which can be used to transform CCB or its fractions into a HTHQ pitch with the desired composition. For example, HTHQ pitch may be made by a thermal treatment at high temperatures of CCB feedstock under atmospheric, or high pressure, and furthermore such treatment may be in the presence or absence of a catalyst (such as a Friedel-Crafts catalyst), and in the presence of an inert or hydrogen atmosphere. Because of the economic savings involved, my preferred process is to carry out the process of this invention at atmospheric pressure in an inert atmosphere such as nitrogen.

In general, my invention can be considered to be composed of a three-stage process for the production of a HTHQ pitch. This process requires high temperatures in the range of about 380° to about 450° C. The required temperature is, of course, dependent upon the CCB fraction used as a feedstock, and whether or not a catalyst is present. When CCB distillate is used as the feedstock, for example, temperature in the range of about 420° to about 450° C. is required; when CCB residue is used as the feedstock, temperature in the range of about 380° to about 440° C. is required. The treatment of the CCB distillate fraction can be carried out in a temperature range of about 400° C. to 450° C. and for a period of time ranging from 30 minutes to 1200 minutes.

The first stage of my process comprises the vacuum stripping or fractional distillation of CCB at elevated temperatures. The second stage comprises the thermal treatment of the vacuum stripped CCB or CCB distillate at a high temperature of about 380° to about 450° C. This treatment may be carried out under atmospheric pressure, high pressure, or low pressure. In addition, the treatment may be carried out in the absence or presence of a suitable aromatic condensation catalyst. Such catalysts are well known in the art as being Friedel-Crafts catalysts such as anhydrous aluminum chloride or anhydrous ferric chloride. The treating can be conducted in the presence of a catalyst and in a temperature range of about 370° C. to 400° C. The third and last stage of my invention comprises the vacuum stripping of the thermally treated mixture from stage two at a low temperature of about 300° to about 360° C., and at a pressure of about 1 to about 5 mm of mercury. The objective of this stage is to remove all undesirable oils thus concentrating and increasing the liquid crystal fraction, that is, Ti and Qi in the pitch. To accomplish this, the use of the low temperature is critical at this stage.

To be more specific, in the laboratory experimental procedure to prepare HTHQ pitch, the total CCB is vacuum stripped or fractionally distilled at elevated temperatures to prepare the desired fraction of CCB. The desired fraction is then thermally treated under atmospheric pressure conditions, and in the presence or absence of a catalyst (continuous agitation of the fraction at this time will avoid coke formation). After treatment, the temperature of the mixture is rapidly lowered to around 300° C. and the pressure is reduced to about 1 to about 10 mm Hg, after which the temperature is increased slowly, with agitation, to about 360° to about 370° C. to remove at least 1% of the distillable oil from the mixture, preferably more than 10%. The mixture is then cooled to room temperature under reduced pressure or under nitrogen atmosphere.

Alternatively, the thermal treatment stage can also be carried out under reduced (10–200 mm Hg) pressure. The treating can be carried out in a temperature range of about 400° C. to about 450° C., and 10–200 mm Hg for a period of time ranging from about 30 minutes to about 600 minutes. In this instance, when the thermal treatment is completed, the mixture is cooled to room temperature under reduced pressure or a nitrogen atmosphere.

The time required to produce HTHQ pitch is dependent on the temperature used during the thermal treatment of the CCB fraction. Generally, the higher the temperature of the thermal treatment, the shorter is the time required to produce a HTHQ pitch. The desired time and temperature required to produce a HTHQ pitch depends on the CCB fraction. When using a CCB residue which has a higher molecular weight and aromatic ring distribution than the CCB distillate, less time and lower temperature will be required to produce a HTHQ pitch.

It is believed that one of ordinary skill in the art can, using the preceding description, utilize the present invention to its fullest extent. The following specific embodiments are, therefore, to be construed as merely illustrative of this invention, and are not meant to limit the remainder of the specification and claims in any way whatsoever.

Examples 1–4 illustrate the production of HTHQ pitch, according to the present invention by the atmospheric thermal treatment of vacuum stripped CCB;

Examples 5–8 illustrate the production of HTHQ pitch, according to the present invention, by the atmospheric heat soaking of a CCB distillate fraction;

Example 9 illustrates the production of HTHQ pitch, according to the present invention, by the vacuum heat soaking of vacuum stripped CCB; and Example 10 illustrates the production of HTHQ pitch, according to the present invention, by the catalytic heat soaking of a vacuum stripped CCB fraction.

TABLE V

THE PRODUCTION OF HTHQ PITCH BY ATMOSPHERIC THERMAL TREATMENT OF VACUUM STRIPPED CCB

| Example | First Vacuum Stripping Stage | | | Heat Soaking Stage | | Second Vacuum Stripping Stage | | | | Pitch Composition after Stripping | | | |
|---|---|---|---|---|---|---|---|---|---|---|---|---|---|
| | Temp. (°C.) | Press. (mm Hg) | Oil Removed (%) | Time | Temp. (°C.) | Temp. (°C.) | Press. (mm Hg) | Oil (%) | Pitch (%) | Toluene Insolubles (%) | Quinoline Insolubles (%) | Melting Point of TiSep (°C.) | Optical Anistropicity (%) |
| 1 | 280 | 78.0 | 35.8 | 4 hrs. | 430 | 380 | 7.8 | — | — | 68.0 | 20.7 | 300–325 | 100 |
| 2 | 280 | 7.0 | 39.1 | 5 hrs. | 430 | 380 | 14.0 | 27.6 | — | 68.4 | 26.0 | 300–325 | 100 |
| 3 | 380 | 7.5 | 88.0 | 1 hr. | 430 | 380 | 6.0 | 1.3 | 6.2 | 70.0 | 43.2 | 275–300 | 100 |
| 4 | 380 | 5.0 | 92.7 | 1½ hrs. | 430 | 380 | 5.0 | 0.9 | 4.2 | 76.0 | 57.4 | 275–300 | 100 |

*Figures in ( ) = melting point (°C.).

TABLE VI

THE PRODUCTION OF HTHQ PITCH BY THE ATMOSPHERIC HEAT SOAKING OF CCB DISTILLATE FRACTION

| Example | CCB Distillate Boiling Point (°C.) | Heat Soaking Stage Temp. (°C.) | Heat Soaking Stage Time (Hrs) | Pitch Yield (%) | Pitch Composition after Stripping: Toluene Insolubles (%) | Pitch Composition after Stripping: Quinoline Insolubles (%) | Pitch Composition after Stripping: Optical Anistropicity (%) |
|---|---|---|---|---|---|---|---|
| 5 | CCB Distillate (454–471° C.) | 440 | 3 | 22.1 | 67.0 | 33.0 | — |
| 6 | CCB Distillate (471–488° C.) | 450 | 3 | 31.6 | 73.0 | 30.0 | 100 |
| 7 | CCB Distillate (488–510° C.) | 440 | 5 | 37.3 | 89.0 | 39.0 | — |
| 8 | | | | | | | — |

TABLE VII

THE PRODUCTION OF HTHQ PITCH BY THE VACUUM HEAT SOAKING OF VACUUM STRIPPED CCB

| Heat Soaking Stage: Temp. | Heat Soaking Stage: Time | Heat Soaking Stage: Press. | Pitch Composition after Stripping: Toluene Insolubles | Pitch Composition after Stripping: Quinoline Insolubles |
|---|---|---|---|---|

TABLE VII-continued

| Example | (°C.) | (Hrs) | (mm Hg) | (%) | (%) |
|---|---|---|---|---|---|
| 9 | 420 | 1.0 | 75 | 70.0 | 24.5 |

THE PRODUCTION OF HTHQ PITCH BY CATALYTIC HEAT SOAKING PLUS VACUUM OF VACUUM STRIPPED CCB FRACTION

| Example | Catalyst Type | Catalyst (wt %) | Heat Soaking Stage Temp. (°C.) | Heat Soaking Stage Time (Hrs) | Pitch Composition after Stripping Toluene Insoluble (%) | Pitch Composition after Stripping Quinoline Insolubles (%) |
|---|---|---|---|---|---|---|
| 10 | Anhydrous Aluminum Chloride | 1.0 | 400 | 1.0 | 57 | 24.1 |

From the foregoing description one skilled in the art can easily ascertain the essential characteristics of this invention and without departing from the spirit and scope thereof can make various changes and/or modifications to the invention for adapting it to various usages and conditions. Accordingly, such changes and modifications are properly intended to be within the full range of equivalents of the following claims.

Having thus described my invention and the manner and process of making and using it in such full, clear, concise and exact terms as to enable any person skilled in the art to which it pertains, or with which it is most nearly connected, to make and use the same, and having set forth the best modes for carrying out my invention:

I claim:

1. A process for the preparation of an aromatic pitch suitable for manufacturing a carbon product with an anisotropic structure comprising:

providing a cat cracker bottom;

distilling said cat cracker bottom to obtain a distillate fraction, said distillate fraction having a boiling point in the range of from about 500° F. to about 1000° F.;

treating said fraction at a temperature within the range of about 400° C. to about 450° C. and 10–200 mm Hg for a period of time ranging from about 30 to about 600 minutes to produce an aromatic pitch containing a toluene insoluble content of 50 to 90 weight percent and a quinoline insoluble content of 10 to 60 weight percent; and stripping said treated fraction to remove a portion of the distillable oil from the treated mixture.

2. The process of claim 1 wherein said treating is conducted in the presence of a catalyst and in a temperature range of about 370° C. to 400° C.

3. The process of claim 1 wherein said thermal treatment is carried out in an inert atmosphere.

4. The process of claim 1 wherein said thermal treatment is carried out in hydrogen atmosphere.

5. The process of claim 1 wherein the catalyst is a Friedel-Crafts catalyst.

* * * * *